US009187305B1

(12) United States Patent
Olt

(10) Patent No.: US 9,187,305 B1
(45) Date of Patent: Nov. 17, 2015

(54) SCREW CAP REMOVAL TOOL

(71) Applicant: William Olt, Sicklerville, NJ (US)

(72) Inventor: William Olt, Sicklerville, NJ (US)

( * ) Notice: Subject to any disclaimer, the term of this patent is extended or adjusted under 35 U.S.C. 154(b) by 244 days.

(21) Appl. No.: 13/954,078

(22) Filed: Jul. 30, 2013

(51) Int. Cl.
*B67B 7/18* (2006.01)
*B67B 7/16* (2006.01)

(52) U.S. Cl.
CPC .... *B67B 7/18* (2013.01); *B67B 7/16* (2013.01)

(58) Field of Classification Search
CPC ..... B67B 7/12; B67B 7/14; B67B 7/15; B67B 7/16; B67B 7/18
USPC ..... 81/3.09, 3.29, 3.4; D8/40
See application file for complete search history.

(56) References Cited

U.S. PATENT DOCUMENTS

D184,726 S * 3/1959 Gill ..... D8/40
3,919,901 A 11/1975 Braman
4,337,678 A 7/1982 Mumford
4,726,264 A * 2/1988 Bost ..... 81/3.4
4,760,763 A * 8/1988 Trick et al. ..... 81/3.09
5,022,288 A * 6/1991 Taktakian ..... 81/3.4
6,666,110 B1 12/2003 Buettner
7,152,505 B2 12/2006 Chan et al.
7,267,031 B1 9/2007 Burton et al.
D553,926 S 10/2007 Velez
7,748,293 B2 * 7/2010 Elwell ..... 81/3.4
2005/0193867 A1 9/2005 Haynes
2008/0072709 A1 3/2008 Dye

* cited by examiner

*Primary Examiner* — Hadi Shakeri

(57) ABSTRACT

The screw cap removal tool is a cylindrical-shaped or cylinder that is slightly tapered, and that is further defined with a top surface, a bottom surface, and a peripheral surface. The bottom surface includes an opening that extends upwardly into the screw cap removal tool, and which provides a first series of teeth that extend a first height before a second series of teeth extend upwardly for a second height. The first series of teeth form a first inner diameter that is greater than a second inner diameter of the second series of teeth. The first series of teeth are configured to engage against an outer surface of a first sized screw cap in order for the screw cap removal tool to unscrew said first sized screw cap; whereas the second series of teeth are configured to engage against an outer surface of a second sized screw cap.

3 Claims, 7 Drawing Sheets

SCREW CAP REMOVAL TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of tools, more specifically, a tool particularly adapted to unscrew differently sized caps from different bottles.

SUMMARY OF THE INVENTION

An embodiment of the disclosure meets the needs presented above by generally comprising a cylindrical-shaped or tapered cylinder-shaped object that is further defined with a top surface, a bottom surface, and a peripheral surface. The bottom surface includes an opening that extends upwardly into the screw cap removal tool, and which provides a first series of teeth that extend a first height before a second series of teeth extend upwardly for a second height. The first series of teeth form a first inner diameter that is greater than a second inner diameter of the second series of teeth. The first series of teeth are configured to engage against an outer surface of a first sized screw cap in order for the screw cap removal tool to unscrew said first sized screw cap; whereas the second series of teeth are configured to engage against an outer surface of a second sized screw cap. The surface includes a magnetic ring used to attach the screw cap removal tool against a ferrous object for storage purposes. The peripheral surface includes a gripping surface that is flexible to aid in gripping for increased torque when used in connection with either the first sized screw cap or second sized screw cap.

An object of the invention is to provide a screw cap removal tool that is specially adapted to unscrew differently sized screw caps from different bottles.

These together with additional objects, features and advantages of the screw cap removal tool will be readily apparent to those of ordinary skill in the art upon reading the following detailed description of presently preferred, but nonetheless illustrative, embodiments of the screw cap removal tool when taken in conjunction with the accompanying drawings.

In this respect, before explaining the current embodiments of the screw cap removal tool in detail, it is to be understood that the screw cap removal tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the screw cap removal tool.

It is therefore important that the claims be regarded as including such equivalent construction insofar as they do not depart from the spirit and scope of the screw cap removal tool.

It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
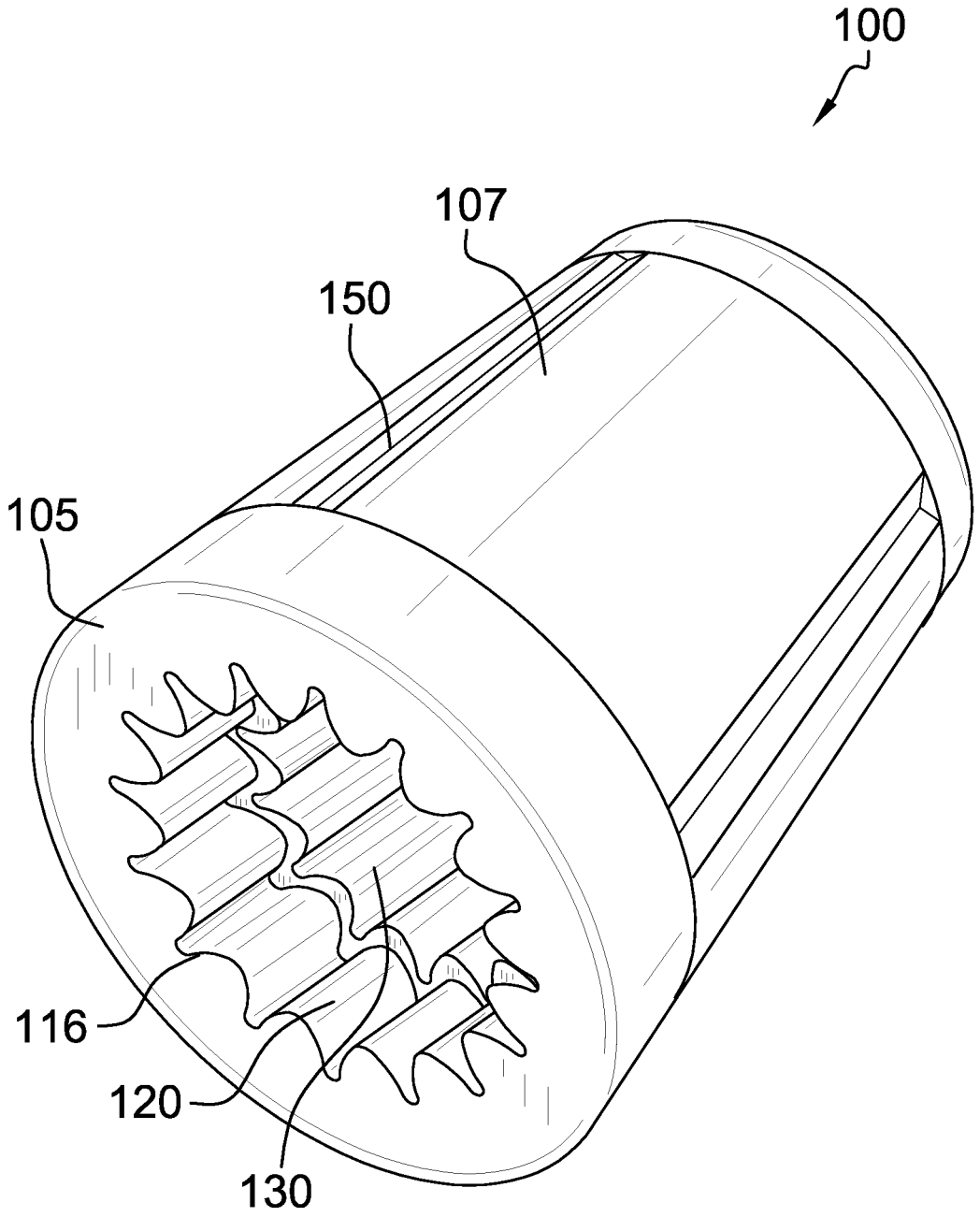
FIG. 1 is a bottom, perspective view of the screw cap removal tool.
Figure 2:
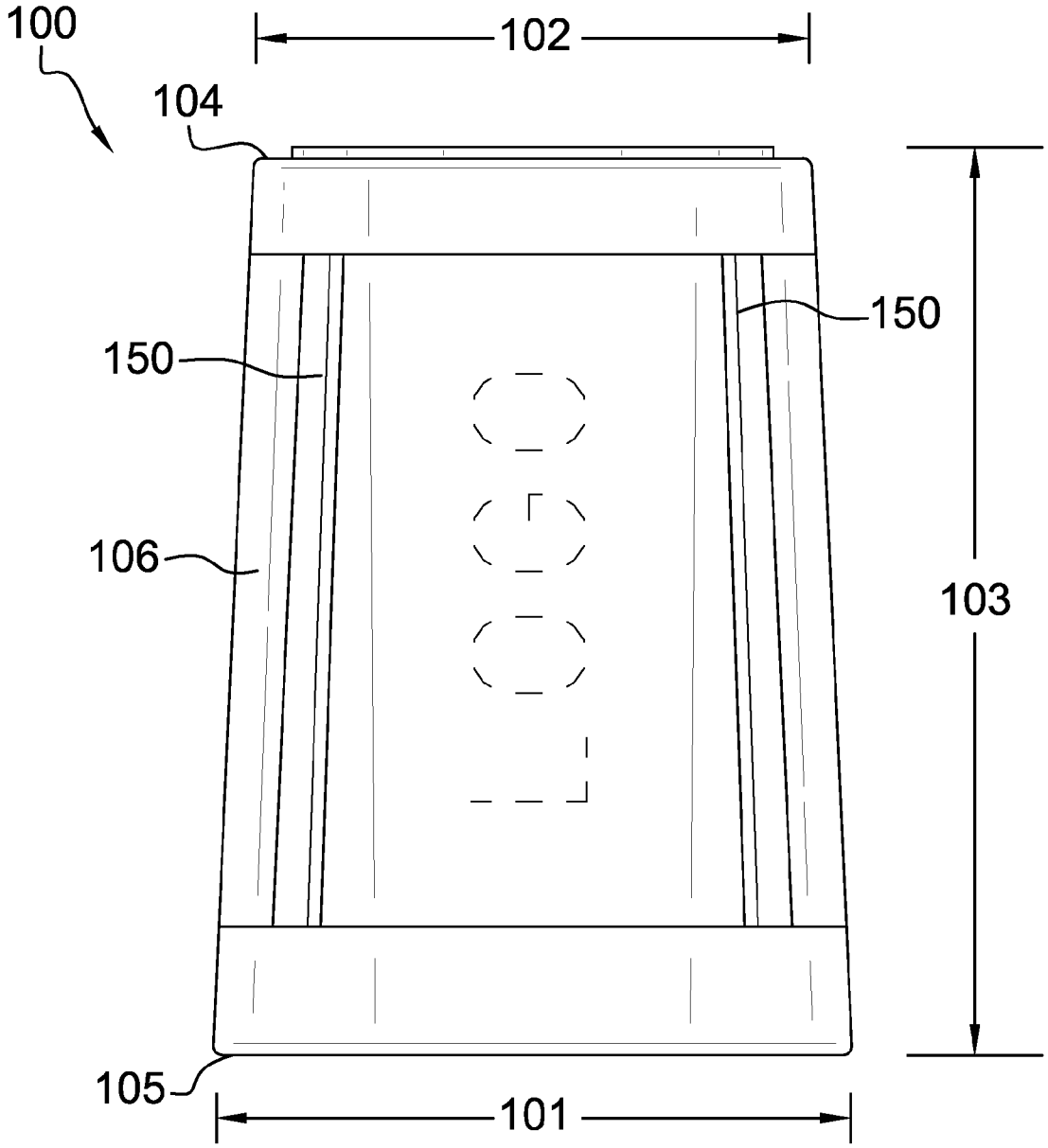
FIG. 2 is a side view of the screw cap removal tool.
Figure 3:
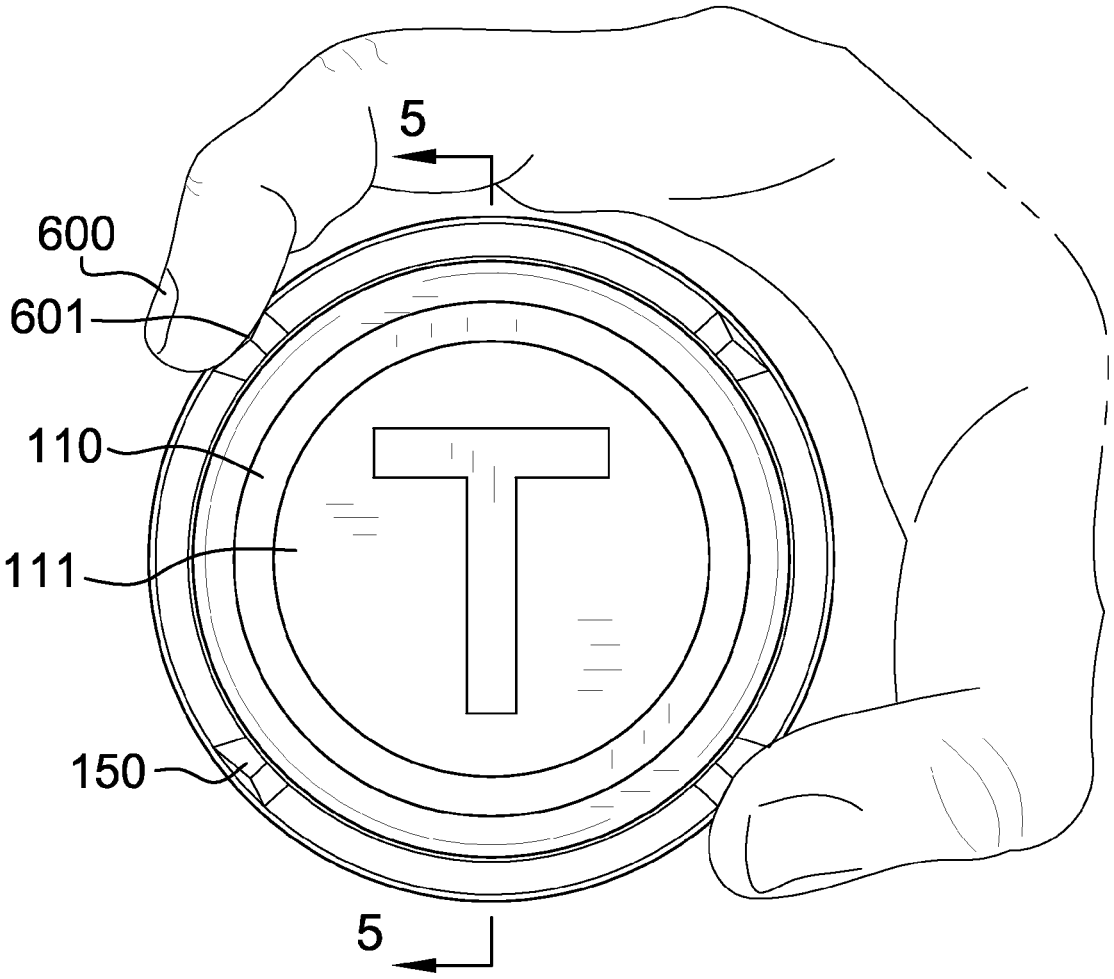
FIG. 3 is a top view of the screw cap removal tool.
Figure 4:
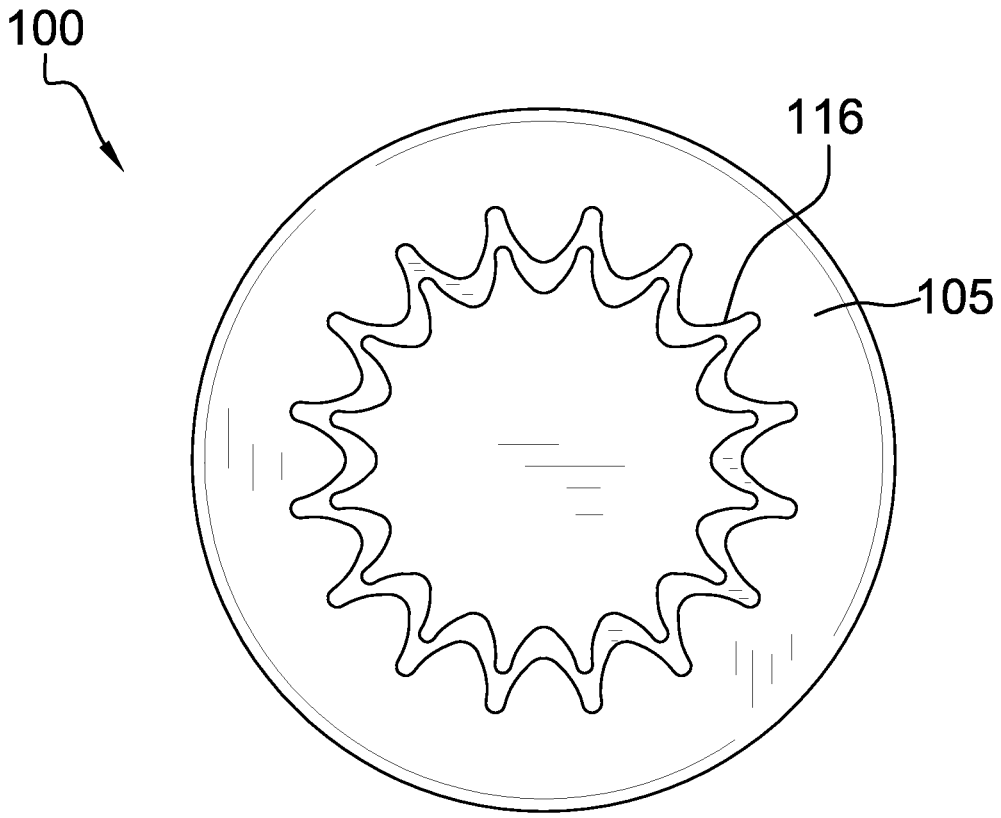
FIG. 4 is a bottom view of the screw cap removal tool.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 7, the screw cap removal tool 100 (hereinafter invention) is further defined as a cylindrical-shaped object or a tapered cylinder. The tapered cylinder shape of the invention 100 includes a first outer diameter 101 and a second outer diameter 102. The first outer diameter 101 is greater than the second outer diameter 102. The first outer diameter 101 is not less than 2 inches, but not more than 6 inches; whereas the second outer diameter 102 is not less than 0.5 inches, but not more than 5 inches. The invention 100 includes a height 103, which ranges from 2 inches to 20 inches. The invention 100 is further defined with a top surface 104, a bottom surface 105, and a peripheral surface 106.

The top surface 104 is adorned with a magnetic ring 110 and a logo member 111. The magnetic ring 110 enables the invention 100 to be secured against a ferrous object 200 when not in use. The logo member 111 may be of a felt construction.

The peripheral surface 106 may includes a gripping member 107 into the construction of the peripheral surface 106. The gripping member 107 may be made of a material like rubber, which has a high coefficient of friction, and aids an end user in grasping the invention 100. Moreover, the peripheral surface 106 and the gripping member 107 include contouring indentations 150 at various locales along the peripheral surface 106. The contouring indentations 150 are longitudinally-oriented, and provide increased gripping locales with which a fingertip 601 of a finger 600 is able to engage there against.

The bottom surface 105 includes an opening 116 that extends upwardly into the invention 100. The opening 106 is composed of a first series of teeth 120 that extend a first height 121 before a second series of teeth 130 extend upwardly for a second height 131. The first series of teeth 120 form a first inner diameter 122 that is greater than a second inner diameter 132 of the second series of teeth 130. The first series of teeth 120 are configured to engage against an outer surface 301 of a first sized screw cap 300 in order for the invention 100 to unscrew said first sized screw cap 300. The second series of teeth 130 are configured to engage against an outer surface 401 of a second sized screw cap 400. The first sized screw cap 300 is larger than the second sized screw cap 400.

Figure 5:
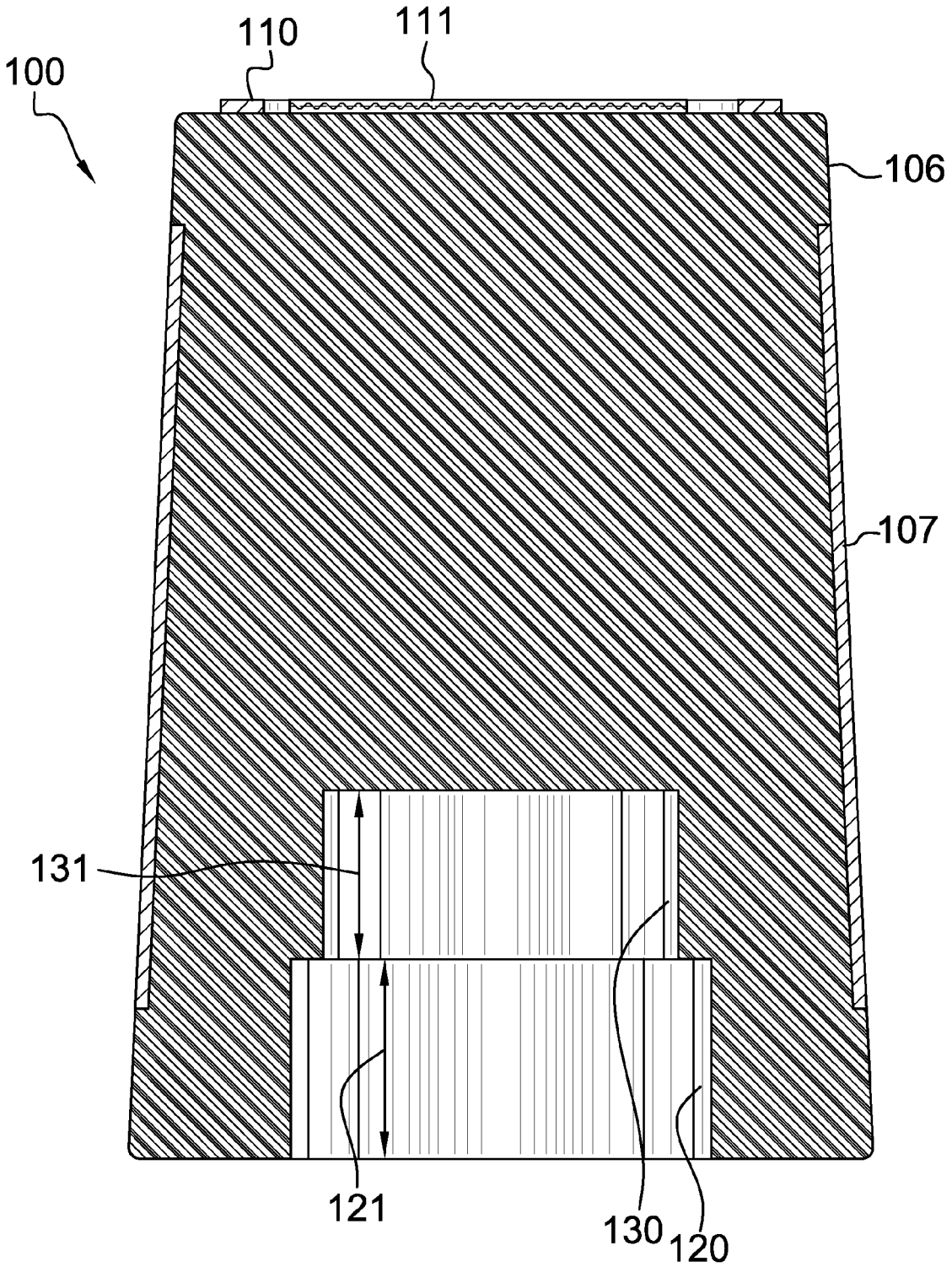
FIG. 5 is a cross-sectional view of the screw cap removal tool along line 5-5 in FIG. 3.
Figure 6:
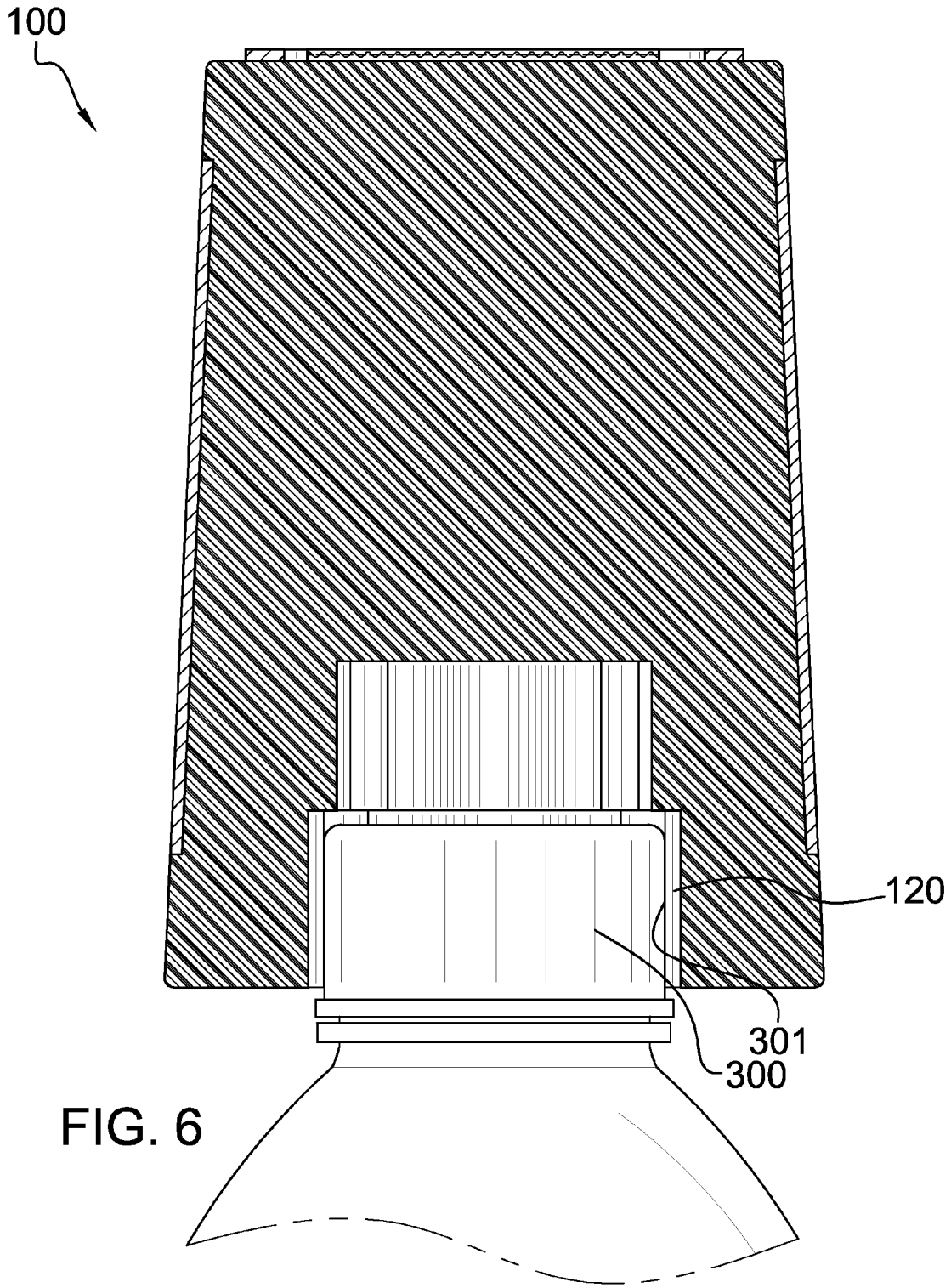
FIG. 6 is a cross-sectional view of the screw cap removal tool along line 5-5 in FIG. 3, and depicting removal of a first sized screw cap.
Figure 7:
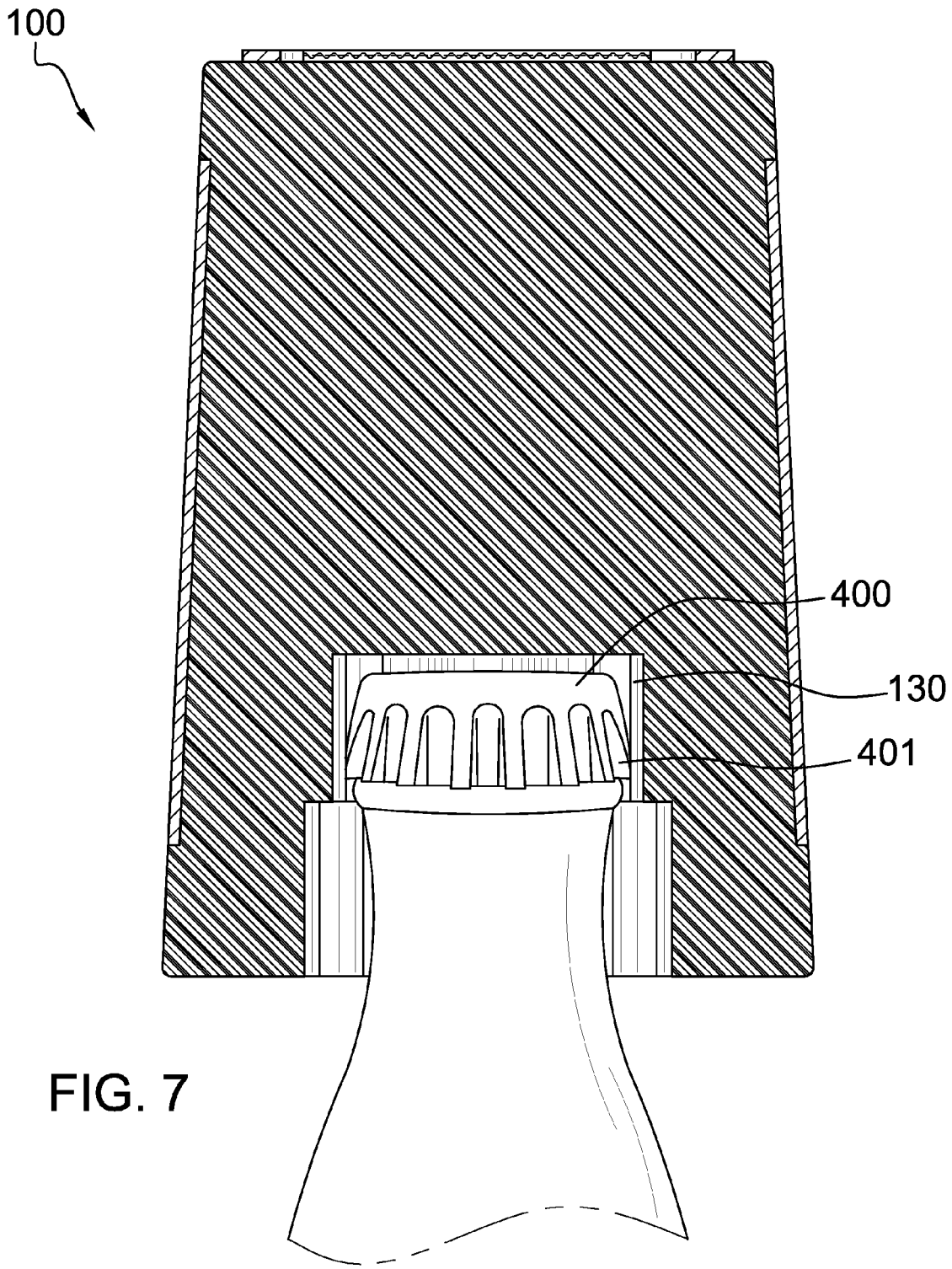
FIG. 7 is another cross-sectional view of the screw cap removal tool along line 5-5 in FIG. 3, and depicting removal of a second sized screw cap.

In referring to FIGS. 5-7, it shall be noted that the invention 100 includes a foam core or is constructed of a flexible material. Moreover, the gripping member 107 is secured to the peripheral surface 106, and aids in grasping the invention 100.

The first series of teeth 120 and the second series of teeth 130 both form a star pattern within the opening 116. Moreover, the first series of teeth 120 and the second series of teeth 130 mirror one another, and include the same number of individual teeth protuberances. The first series of teeth 120 and the second series of teeth 130 provide the invention 100 with the ability to unscrew differently-sized screw caps (300 and 400).

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A screw cap removal tool comprising:

a tapered cylinder having an opening in a bottom surface that extends upwardly to a first series of teeth and a second series of teeth;

a first sized screw cap is configured to be unscrewed via the first series of teeth;

a second sized screw cap is configured to be unscrewed via the second series of teeth;

wherein the tapered cylinder includes a first outer diameter and a second outer diameter, and a height;

wherein the first outer diameter is greater than the second outer diameter;

wherein the tapered cylinder is further defined with a top surface, and a peripheral surface; wherein the top surface is adorned with a magnetic ring and a logo member; wherein the magnetic ring is configured to secure the screw cap removal tool a ferrous object when not in use;

wherein the peripheral surface includes a gripping member; wherein the peripheral surface and the gripping member include contouring indentations at various locales along the peripheral surface;

wherein the contouring indentations are longitudinally-oriented, and provide increased gripping locales with which are configured to accept a fingertip of a finger to engage there against;

wherein the first series of teeth extend a first height before the second series of teeth extend upwardly for a second height; wherein the first series of teeth form a first inner diameter that is greater than a second inner diameter of the second series of teeth;

wherein the first series of teeth are configured to engage against an outer surface of the first sized screw cap in order to unscrew said first sized screw cap; wherein the second series of teeth are configured to engage against an outer surface of the second sized screw cap; wherein the first sized screw cap is larger than the second sized screw cap;

wherein the first series of teeth and the second series of teeth both form a star pattern within the opening; wherein the first series of teeth and the second series of teeth mirror one another, and include the same number of individual teeth protuberances.

2. The screw cap removal tool according to claim 1 wherein the first outer diameter is not less than 2 inches, but not more than 6 inches; wherein the second outer diameter is not less than 0.5 inches, but not more than 5 inches; wherein the height ranges from 2 inches to 20 inches.

3. A screw cap removal tool comprising:

a tapered cylinder having an opening in a bottom surface that extends upwardly to a first series of teeth and a second series of teeth;

a first sized screw cap is configured to be unscrewed via the first series of teeth;

a second sized screw cap is configured to be unscrewed via the second series of teeth;

wherein a peripheral surface includes a gripping member; wherein the peripheral surface and the gripping member include contouring indentations at various locales along the peripheral surface; wherein the contouring indentations are longitudinally-oriented, and provide increased gripping locales with which are configured to accept a fingertip of a finger to engage there against;

wherein the first series of teeth extend a first height before the second series of teeth extend upwardly for a second height; wherein the first series of teeth form a first inner diameter that is greater than a second inner diameter of the second series of teeth;

wherein the tapered cylinder includes a first outer diameter and a second outer diameter, and a height;

wherein the first outer diameter is greater than the second outer diameter;

wherein the tapered cylinder is further defined with a top surface, and a peripheral surface; wherein the top surface is adorned with a magnetic ring and a logo member; wherein the magnetic ring is configured to secure the screw cap removal tool a ferrous object when not in use;

wherein the first series of teeth are configured to engage against an outer surface of the first sized screw cap in order to unscrew said first sized screw cap; wherein the second series of teeth are configured to engage against an outer surface of the second sized screw cap;

wherein the first outer diameter is not less than 2 inches, but not more than 6 inches; wherein the second outer diameter is not less than 0.5 inches, but not more than 5 inches; wherein the height ranges from 2 inches to 20 inches;

wherein the first sized screw cap is larger than the second sized screw cap;

wherein the first series of teeth and the second series of teeth both form a star pattern within the opening; wherein the first series of teeth and the second series of teeth mirror one another, and include the same number of individual teeth protuberances.

* * * * *